United States Patent [19]

Rahe

[11] Patent Number: 4,747,740

[45] Date of Patent: May 31, 1988

[54] SYSTEM FOR SETTING THE VERTICAL POSITION OF THE ROUNDING BAR IN A BOOK BLOCK ROUNDING AND BACKING MACHINE

[75] Inventor: Karl-Ludwig Rahe, Preussisch Oldendorf, Fed. Rep. of Germany

[73] Assignee: Kolbus GmbH & Co. KG, Rahden, Fed. Rep. of Germany

[21] Appl. No.: 42,308

[22] Filed: Apr. 24, 1987

[30] Foreign Application Priority Data

Apr. 26, 1986 [DE] Fed. Rep. of Germany ..... 3614168

[51] Int. Cl.[4] ..... B42C 13/04

[52] U.S. Cl. ..... 412/11; 412/30

[58] Field of Search ..... 412/10, 11, 29, 30

[56] References Cited

U.S. PATENT DOCUMENTS

| | | | |
|---|---|---|---|
| 158,697 | 1/1875 | Coffin | 412/30 |
| 3,280,413 | 10/1966 | Robbins et al. | 412/30 X |
| 3,413,669 | 12/1968 | Thorp | 412/30 X |
| 3,953,277 | 4/1976 | Kuhns | 412/11 X |

*Primary Examiner*—Paul A. Bell

*Attorney, Agent, or Firm*—Chilton, Alix & Van Kirk

[57] ABSTRACT

In a system for setting the vertical position of the rounding bar in a book block rounding and backing machine which possesses a support bearing unit, within which the rounding bar that acts on the spine of the book block reciprocates, the support-bearing unit is adjusted in the vertical direction, in side frames, by means of adjusting spindles, so as to set its vertical position, and is immobilized in the side frames by means of a clamping arrangement. The support bearing unit 7 is carried in a frame 4 and can, with the rounding bar 3, be deposited, by their own dead weight, onto the spine of a book block 1. The support bearing unit 7 is supported on intermediate supporting elements **24, 24*a* so that it cannot descent below them, while being free to slide upwards. The intermediate supporting elements 24, 24*a* are lowered by means of adjusting spindles 22 which can be motor driven. Once the rounding bar 3 has been deposited onto the spine of the book block 1, the intermediate supporting elements 24, 24*a* can be lowered through a further, defined travel distance, into a datum end position. Furthermore, a switch device 31, 32 is provided, which enables the rotation of the adjusting spindles 22 to be switched off, once the datum end position has been reached, and which enables a ram-type actuator 37 to be activated so as to operate a clamping arrangement 33–36 for automatically immobilizing the support-bearing unit 7 in the side frame 4**.

20 Claims, 1 Drawing Sheet

SYSTEM FOR SETTING THE VERTICAL POSITION OF THE ROUNDING BAR IN A BOOK BLOCK ROUNDING AND BACKING MACHINE

BACKGROUND OF THE INVENTION

The present invention relates to a system for setting the vertical position of the rounding bar in a book block rounding and backing machine.

In vertical adjustment systems commonly found in book block rounding and backing machines, the operation of setting the rounding bar to any given book block level is performed by manual rotation of adjusting spindles, by the machine operator, without precise advance information. This means that the selection of the pressure which the rounding bar will exert on the book block is left to the discretion of whoever performs the setting operation. Under these circumstances, incorrect settings can result, especially if the adjustments are made by relatively poorly trained personnel.

Moreover, manual setting of the vertical position frequently necessitates a readjustment operation, so that, regarded as a whole, the machine changeover operation is extraordinarily time-consuming. Once the rounding bar, held by a support-bearing unit, has been set to the required level the support-bearing unit itself must be immobilized in a side frame. This also is carried out by hand, using a clamping arrangement.

SUMMARY OF THE INVENTION

The object of the present invention is to provide a system for setting the vertical position of the rounding bar, which enables the setting operation to be carried out automatically and within an extremely short space of time. The invention is further intended to ensure that while the rounding bar is being set to the required level, it bears against the spine of the book block with a pressure which never varies, so as to reach a defined starting position, irrespective of the book format.

In accordance with the invention, the support bearing unit is carried in a side frame and can, with the rounding bar, be deposited, by their own dead weight, onto the spine of a book block. The support bearing unit is supported on intermediate supporting elements, so that it cannot descend below them, while being free to slide upwards. The intermediate supporting elements are lowered by means of adjusting spindles which can be motor driven. Once the rounding bar has been deposited onto the spine of the book block, the intermediate supporting elements can be lowered through a further, defined travel distance, into a datum end position. Furthermore, a switch device is provided, which enables the rotation of the adjusting spindles to be switched off, once the datum end position has been reached, and which enables a ram-type actuator to be activated so as to operate a clamping arrangement for automatically immobilizing the support-bearing unit in the side frame.

BRIEF DESCRIPTION OF THE DRAWINGS

The following description provides a more detailed explanation of the preferred embodiment of the invention, made with reference to the accompanying drawings, in which.

DESCRIPTION OF THE PREFERRED EMBODIMENT

Figure 2:
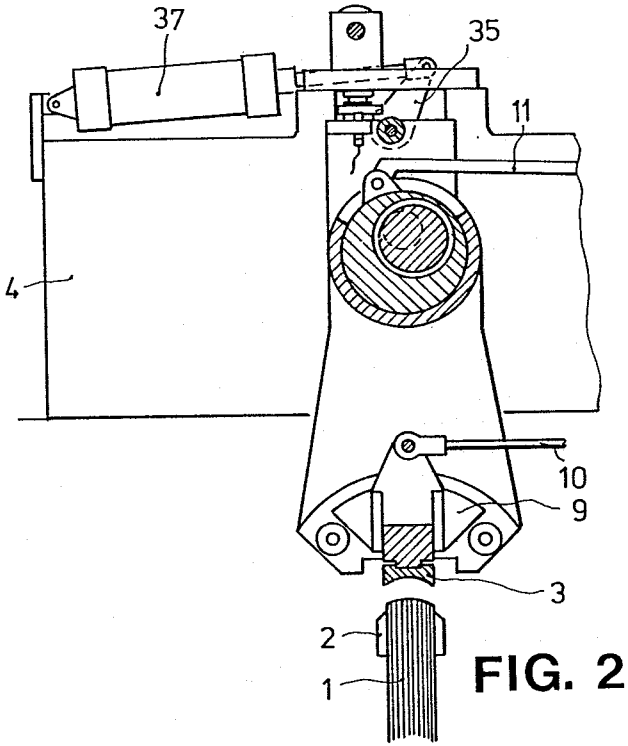
FIG. 2 shows a section along the line A–B in FIG. 1.
Figure 1:
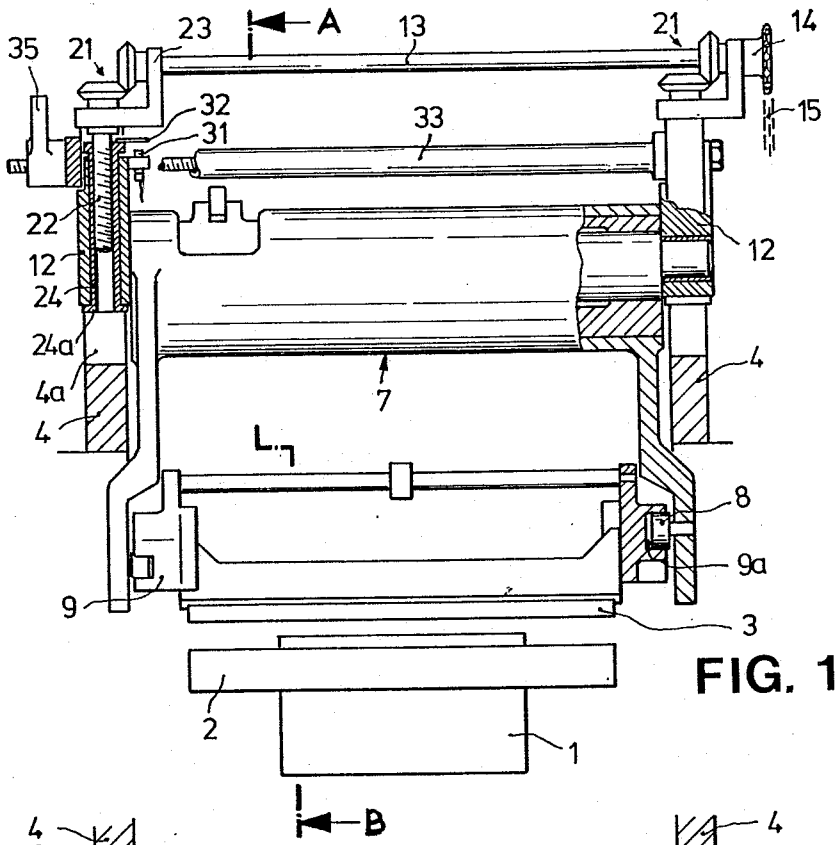
FIG. 1 shows a front view of the backing station of a book block rounding and backing machine, equipped with the vertical adjustment system according to the invention.
Figure 3:
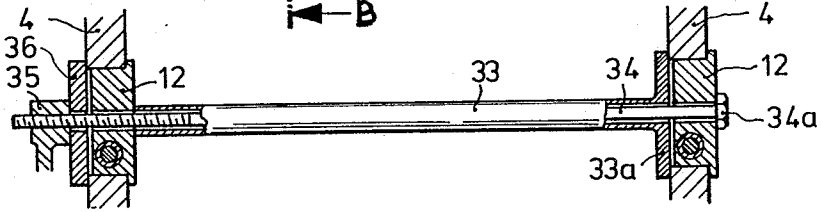
FIG. 3 shows a detail representation of the clamping arrangement, in plan view.

With reference to FIGS. 1–3, a support bearing unit 7 is located in a frame composed of parallel, spaced-apart side members 4. The support-bearing unit 7 possesses a bearing arm on each side, with freely rotatable rollers 8 installed on each of these arms, lying on an arc. These rollers serve as the movement path of a bridge 9 which carries a rounding bar 3, and which is provided, on both sides, with channels 9*a* that run in directions corresponding to the path of the rollers. The rounding bar 3 is caused to reciprocate, in a known manner, by means of a driving rod 10 which is driven from the main drive and acts on the bridge 9 via an articulated connection.

As FIGS. 1 and 3 show particularly clearly, mounting of the support-bearing unit 7, in the side members 4, is effected by using sliders 12 rigidly connected to the unit 7, which can slide freely in the vertical plane, in guideways 4*a* within the side members 4.

In order to set the two sliders 12 to the required level, and hence to set the vertical position of the bearing unit 7, with the rounding bar 3, a common shaft 13 is provided, this shaft 13 being rotated by a chainwheel 14 which is driven, via a chain 15, by a motor that is not shown in the drawing.

Adjusting spindles 22 are arranged to be rotated by means of their engagement with the shaft 13, through pairs of bevel gears 21. The adjusting spindles 22 carry the sliders 12 via internally-threaded sleeves 24. The slider 12 is supported on a stop or shoulder 24*a* of the sleeve 24, so that it cannot descend below this shoulder 24*a*, while being free to be slid along the sleeve 24 in the opposite direction. The shoulder 24*a* is capable of supporting the full dead weight of the unit 7.

Right-angle bearing brackets 23 are fastened to the side members 4, and serve to support the shaft 13 and the two adjusting spindles 22. Thus, the shaft 13 and spindle 22 are in fixed vertical relation to the side members 4.

The two adjusting spindles 22 consequently enable the bearing unit 7, which is carried by the sliders 12, to be lowered, with the rounding bar 3, onto the spine of a book block 1, so that in the starting position for the backing operation, the rounding bar 3 acts against the book block spine with a pressure which is given by the total dead weight of the components that have been lowered.

In order to switch off the rotation of the adjusting spindles 22, a switch device is provided, consisting of a proximity switch 31 which is fastened to one of the sliders 12, and which can be brought into interactive coupling with a tripping lug 32 on the sleeve 24. The distance between the tripping lug 32 and the proximity switch 31 is predetermined such that the spindle movement is not switched off until a defined vertical clearance is obtained between the slider 12 and the shoulder 24*a* of the sleeve 24, and the lowered components are consequently pressing on the spine of the book block 1 with their full weight.

Once the rounding bar 3 has been lowered, and the vertical position has thus been fixed, the sliders 12 are now immobilized in the guides 4*a* within the side members 4, this being accomplished by means of a clamping arrangement which is carried by the sliders 12 and is movable with them. The clamping arrangement comprises a distance tube 33, which is located between the two side members 4. One side of the tube 33 bears against the inside of one of the sliders 12, while on the other side this tube 33 possesses a welded-on thrust plate 33*a*, by which it bears against the inside of member 4.

A tension rod 34 passes through both the sliders 12, and through the distance tube 33, this tension rod 34 possessing a head 34*a* which, from one side, bearing against the slider 12 from the outside. On the opposite side, a clamping lever 35 fits onto a thread on the tension rod 34, the tensioning force exerted by this clamping lever 35 being transmitted, as tightening proceeds, to a thrust washer 36 which bears against the outside of the other side member 4. In order to apply the clamping force, a cylinder 37 is provided between the clamping lever 35 and the machine frame 4, this cylinder 37 being activated simultaneously with the stopping of the rotation of the adjusting spindles 22, in the sense of immobilizing the sliders 12 in the guides 4*a* within the side members 4, activation of the cylinder 37 being effected by the switch device 31, 32.

I claim:

1. A book block rounding and backing machine comprising:

a frame;

an intermediate support member connected to the frame and having a stop surface thereon;

a support-bearing unit, said unit including means for mounting the unit to the intermediate support member and for permitting free relative vertical movement of the unit within the frame, the downward position of the unit relative to the frame being limited by said stop surface, said unit further including a rounding bar mounted for reciprocating motion while bearing upon the spine of a book block to be positioned beneath the bar;

means for adjusting the vertical position of the intermediate support member relative to the frame, whereby the unit can be lowered toward the spine of a book block, while the dead weight of the unit is supported by said stop surface;

means for detecting a predetermined vertical displacement of the unit relative to the frame, indicative of the transfer of the dead weight of the unit from said stop surface to the spine of the book block; and clamping means responsive to the means for detecting, for immobilizing the unit relative to the frame upon the occurrence of said predetermined vertical displacement, whereupon the reciprocating motion of the rounding bar on the spine of the book can be initiated.

2. The book block rounding and backing machine of claim 1, wherein the means for lowering the intermediate support member includes a threaded spindle engaging threads in the intermediate support member, and motor-driven means for rotating the spindle.

3. The book block rounding and backing machine of claim 2, wherein the frame includes parallel, spaced apart side members, each having a vertical guideway and wherein an intermediate support member in the form of a threaded sleeve in each guideway carries a respective support member.

4. The book block rounding and backing machine of claim 1, wherein said means for detecting a predetermined vertical displacement includes switch means cooperating between the intermediate support member and the means for mounting the unit, for sensing when the means for mounting has been vertically displaced a predetermined distance from said stop surface.

5. The book block rounding and backing machine of claim 4, wherein the switch means comprises a proximity switch on the means for mounting the unit and a tripping lug on the intermediate support member.

6. The book block rounding and backing machine of claim 1 wherein said clamping means includes a ram-type actuator, thereby activating a clamping arrangement operable on the means for mounting the unit and on the frame.

7. The book block rounding and backing machine of claim 1, wherein said frame includes a vertical guideway;

said intermediate member includes a sleeve having a stop shoulder serving as said stop surface; and said means for mounting includes a slider member carried by the sleeve for free vertical movement in said guideway.

8. The book block rounding and backing machine of claim 7, wherein the means for adjusting the vertical position of the intermediate support member includes a driven spindle threaded to the sleeve.

9. The book block rounding and backing machine of claim 8, wherein the means for adjusting the vertical position of the intermediate member includes a shaft, bevel gears operatively connecting the shaft to the spindle, means for fastening the shaft to the frame, and means for rotating the shaft.

10. The book block rounding and backing machine of claim 9, wherein said means for fastening the shaft to the frame includes a bracket fastened to the frame and supporting the shaft and spindle.

11. The book block rounding and backing machine of claim 1, wherein the means for mounting the unit to the intermediate support member is a slider member resting on the support member stop surface, for permitting free upward movement of the unit relative to the support member.

12. The book block rounding and backing machine of claim 11, wherein said frame includes a vertical guideway;

said intermediate member includes a sleeve having a stop shoulder serving as said stop surface; and said means for mounting includes a slider member carried by the sleeve for free vertical movement in said guideway.

13. The book block rounding and backing machine of claim 12, wherein the means for adjusting the vertical position of the intermediate support member includes a driven spindle threaded to the sleeve.

14. The book block rounding and backing machine of claim 11, wherein the means for lowering the intermediate support member includes a threaded spindle engaging threads in the intermediate support member, and motor-driven means for rotating the spindle.

15. The book block rounding and backing machine of claim 14, wherein the frame includes parallel, spaced apart side members, each having a vertical guideway and wherein an intermediate support member in the form of a threaded sleeve in each guideway carries a respective support member.

16. The book block rounding and backing machine of claim 11, wherein said means for detecting a predetermined vertical displacement includes switch means cooperating between the intermediate support member and the means for mounting the unit, for sensing when the means for mounting has been vertically displaced a predetermined distance from said stop surface.

17. The book block rounding and backing machine of claim 11 wherein said clamping means includes a ram-type actuator, thereby activating a clamping arrangement operable on the means for mounting the unit and on the frame.

18. The book block rounding and backing machine of claim 17, wherein the switch means comprises a proximity switch on the means for mounting the unit and a tripping lug on the intermediate support member.

19. The book block rounding and backing machine of claim 11, wherein said frame includes a vertical guideway;

said intermediate member includes a sleeve having a stop shoulder serving as said stop surface; and said means for mounting includes a slider member carried by the sleeve for free vertical movement in said guideway.

20. The book block rounding and backing machine of claim 19, wherein the means for adjusting the vertical position of the intermediate member includes a driven spindle threaded to the sleeve.

* * * * *